United States Patent [19]

Cross et al.

[11] Patent Number: 4,951,540

[45] Date of Patent: Aug. 28, 1990

[54] SHINGLE RIDGE CAP CUTTER

[75] Inventors: James Cross, Grandville; Jerry Henning, Spring Lake; James J. Rhoades, Garden City; Arthur B. Chubb, Romulus; David B. Olsen, Dearborn, all of Mich.

[73] Assignee: Tapco Products Company, Inc., Detroit, Mich.

[21] Appl. No.: 324,309

[22] Filed: Mar. 16, 1989

[51] Int. Cl.[5] ..... B26D 1/12

[52] U.S. Cl. ..... 83/397; 83/467.1; 83/564; 83/589; 83/599; 83/607; 83/694; 83/695; 83/700; 83/DIG. 1; 83/544

[58] Field of Search ..... 83/589, 599, 605, 606, 83/609, 920, DIG. 1, 564, 544, 545, 546, 490, 497.2, 397, 468.1, 467.1, 468.9, 607, 694, 695, 700

[56] References Cited

U.S. PATENT DOCUMENTS

| | | | |
|---|---|---|---|
| 679,167 | 7/1901 | Garding | 83/589 X |
| 949,462 | 2/1910 | Colley | 83/598 |
| 1,092,381 | 4/1914 | Neely | 83/589 |
| 1,252,933 | 1/1918 | Norquest | 83/598 |
| 1,513,640 | 10/1924 | Shaw | 83/605 |
| 1,767,012 | 6/1930 | Pfau | 83/477.2 X |
| 1,918,104 | 7/1933 | Hook | 83/607 |
| 1,981,695 | 11/1934 | Gundlach | 83/515 |
| 2,089,274 | 8/1937 | Laukhuff | 83/589 X |
| 2,090,548 | 8/1937 | Nielsen | 83/605 |
| 2,270,473 | 1/1942 | Procelli | 83/397 |
| 2,518,076 | 8/1950 | Scherig | 83/397 |
| 3,224,314 | 12/1965 | Wolnez | 83/609 X |
| 3,673,920 | 7/1972 | Wahlen et al. | 83/477.2 |
| 3,821,918 | 7/1974 | Niehaus et al. | 83/490 X |
| 3,994,192 | 11/1976 | Faig | 83/490 |
| 4,011,782 | 3/1977 | Clark et al. | 83/490 X |
| 4,224,853 | 9/1980 | Ruotsalainen | 83/605 X |
| 4,637,288 | 1/1987 | Olsen et al. | 83/490 X |

*Primary Examiner*—Frank T. Yost
*Assistant Examiner*—Rinaldi Rada
*Attorney, Agent, or Firm*—Barnes, Kisselle, Raisch, Choate, Whittemore & Hulbert

[57] ABSTRACT

A shingle ridge cap cutter utilized for cutting uniform sections from roof shingles comprising a frame along which a shingle is guided to a manually operated cutter that comprises spaced blades that are moved to sever a section of the shingle. The cutter blades are provided in spaced-apart, non parallel relationship so that a combined rectangular and trapezoidal-shaped ridge cap is made by single movement of the cutter with the roof shingle positioned so that the cutter blades are aligned with the slots along one edge of the shingle. Provision is made for operation to prevent injury to the hands of the worker.

3 Claims, 5 Drawing Sheets

1
10
11
12
13
14
15
21
22
23
25
27
28
29
32
33
41
42
43
44
45
50
51
52
53
54
55
56
57
6

SHINGLE RIDGE CAP CUTTER

This invention relates to the cutting of sections of a roof shingle and particularly to cutting sections for use as ridge caps.

BACKGROUND AND SUMMARY OF THE INVENTION

In the use of roof shingles, is common to cut the shingles for use at various places and this is usually done by hand utilizing a utility knife. More recently, the extensive use of roof vents has necessitated sections of the shingles to be cut for placement over the vents at the gable of the roof. Unless the sections are cut uniformly, the appearance will not be aesthetically pleasing. Furthermore, in order that the proper overlapping of cut sections of shingle may be achieved without irregular edges, it has been proposed that the sections be trapezoidal in shape with the narrower portions being overlapped by the wider portions. It has heretofore been suggested that such ridge caps can be cut from a shingle utilizing a cutter and sequentially orienting the shingle with respect to a cutter blade to provide a ridge cap having non parallel-transverse axis to provide trapezoidal-shaped ridge caps. See, for example, U.S. Pat. Nos. 1,513,640, 1,918,104, 1,981,695, 2,090,548.

Accordingly among the objectives of the present invention are to provide a shingle ridge cap cutter which effectively cuts uniform sections from the length of shingle which are identical in shape and are preferably trapezoidal in shape; which is compact light weight and easy to use; which includes provision for preventing injury to the hands of the worker; which can be locked for safe transport; and which includes indicia for centering the shingles to conserve material.

In accordance with the invention, a shingle ridge cap cutter utilized for cutting uniform sections from roof shingles comprises a frame along which a shingle is guided to a manually operated cutter that comprises spaced blades that are moved to sever a section of the shingle. The cutter blades are provided in spaced-apart, non parallel relationship so that a combined rectangular and trapezoidal-shaped ridge cap is made by single movement of the cutter with the roof shingle positioned so that the cutter blades are aligned with the slots along one edge of the shingle. Provision is made for operation to prevent injury to the hands of the worker.

More specifically the shingle ridge cap cutter comprises of a frame with means for guiding a shingle to a cutter comprising a fixed base on the frame and a movable base pivoted to the fixed base. Spaced blades are fixed on the base and cooperate with spaced blades on the movable portion which can be manually moved to progressively cut a uniform section from the shingle. The cutter blades are provided in spaced-apart, non parallel relationship so that a combined rectangular and trapezoidal-shaped ridge cap is made by single movement of the cutter with the roof shingle positioned so that the cutter blades are aligned with the slots along one edge of the shingle. Provision is made for preventing injury to the worker. In one form an interlock is provided which requires one hand to manipulate the lock and the other hand to manipulate the movable portion of the cutter. In another form a pair of guard plates is provided, one plate on each side of the cutter which are yieldingly urged by gravity so that they fill the space when the cutter is opened and prevent the hand of the worker from entering between the movable and fixed cutters.

DESCRIPTION

Figure 8:
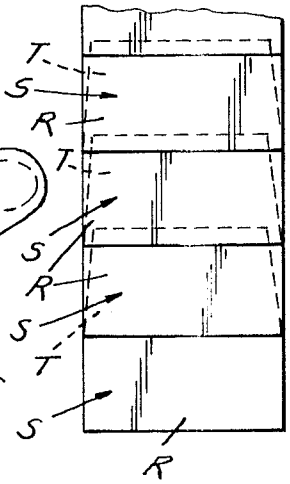
FIG. 8 is a fragmentary plan view showing the manner in which shingle sections are overlapped on a roof vent.
Figure 7:
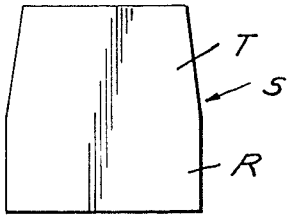
FIG. 7 is a plan view of a typical shingle section cut from a shingle by use of the cutter embodying the invention.
Figure 9:
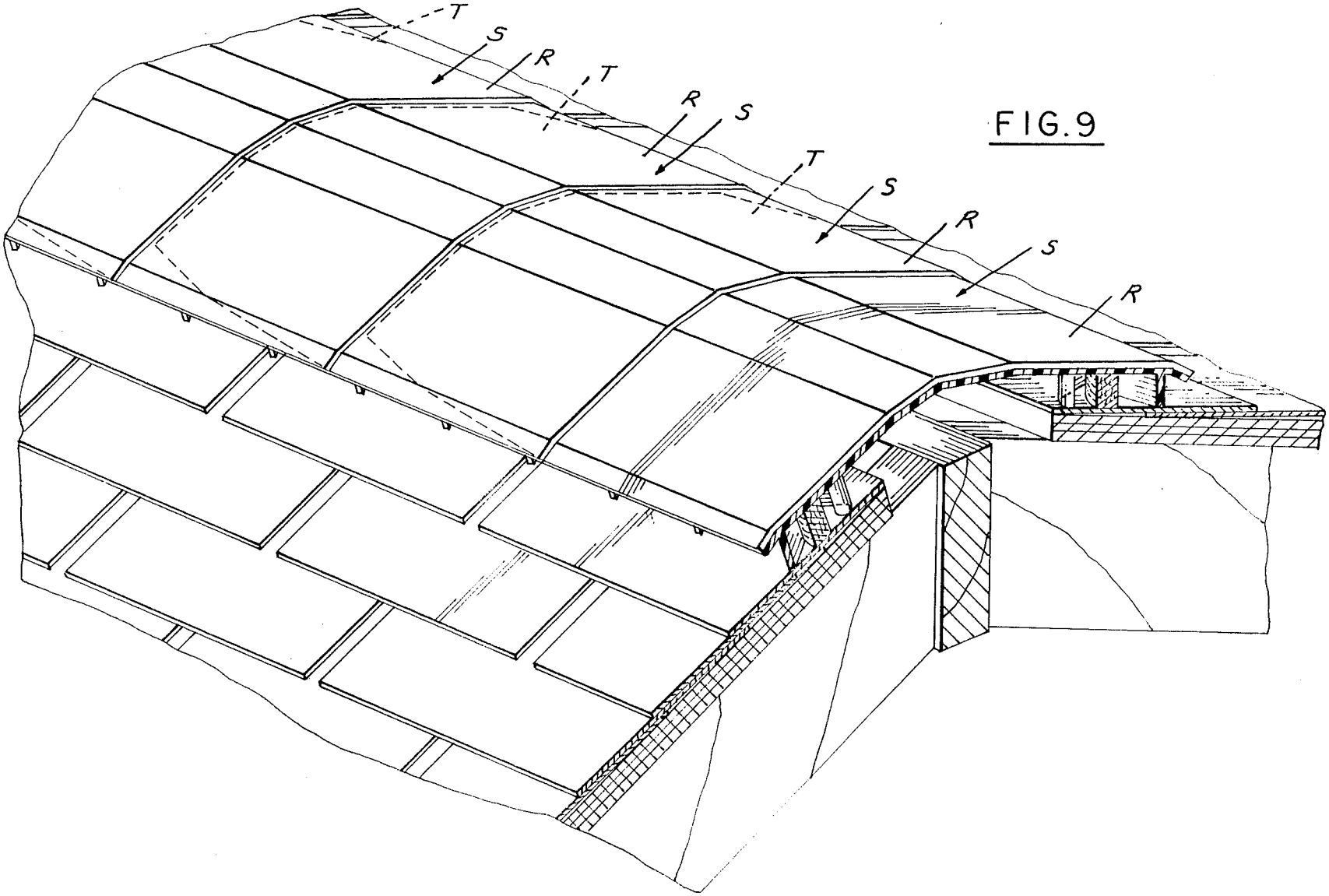
FIG. 9 is a fragmentary part sectional perspective view of a roof utilizing shingle sections over a roof cutter to cut utilizing the cutter embodying the invention.

Referring to FIGS. 7–9, the cutter embodying the invention is adapted to cut sections S from a length of roof shingles which, in accordance with the invention, include a combined rectangular portion R and trapezoidal portion T. The sections S are overlapped on a roof vent as shown in FIG. 8 with the rectangular portions R overlapping the trapezoidal portions T.

Referring to FIGS. 1–4, the shingle ridge cap cutter embodying the invention comprises a frame 10 on which a cutter 11 is mounted and is adapted to be manually operated to cut a sections from a length of shingle L.

The frame 10 comprises a rear rail 12, a front rail 13 a side rail 14 at one end and a horizontal roller 15 at the other end extending between the rails 12 and 13. The roller 15 is mounted on a shaft 16 fixed on the rails 12, 13 by nuts 17, 18 and 19, 20. The shaft 16 extends through blocks 21, 22 on the rails 12, 13. Vertically adjustable feet 23 are provided at the corners of the frame for horizontally adjusting the frame.

The cutter 11 includes a fixed part or base 25 comprising a casting mounted on the frame by bolts 26 and a movable part 27 comprising a casting pivoted by shaft 28 to the base 25. Torsion springs 29 tend to urge the movable part 27 away from the base 25.

Fixed horizontal knife blades 30, 31 having straight edges are provided along the side of the base 25 and cooperate with movable blades 32, 33 on the ends of the movable part 27 to cut a section of a shingle. As shown the blades are provided at an angle to the axis of the frame to provide an equilateral trapezoidal shape as is preferred for a shingle ridge cap. The edges C of move cutters 32, 33 is formed along an arc C so that, as the part 27 is move toward part 25, the edges C progressively cut the shingle providing a clean cut of the shingle which is, it is well known, made of granular material applied to a soft base such as resin or the like. In the cutting, the grit face of the shingle is preferably positioned so that it faces downwardly. The movable part 27 is provided with a handle 44 to facilitate its movement.

In use, the shingle is positioned so that the edges of the fixed blades adjacent the front rail 13 are at the slots X along the one edge of the shingle so that when the shingle section is cut, the resultant section has a combined rectangular portion and trapezoidal portion. In order to facilitate the initial positioning, an indicia mark 40 is provided along the rear rail 12 and this can be utilized in connection with a conventional marking on the underside of the shingle to position the shingle on the cutter.

In order to ensure the safety and prevent injury, provision is made for preventing the entry of a hand of an operator into the cutting area. In this form such provision interlocks the parts 25, 27 so that the part 27 cannot be moved toward the part 25 unless the interlock is actuated. Such an interlock may comprise a pin 41 on the movable part 27 (FIG. 1) which is engaged by a spring arm 42 when the cutter is closed. In order to operate the cutter, the person operating the cutter grips the rear rail 12 and utilizes a finger or thumb to engage a lateral extending loop 43 on the spring arm 42 and move it out of engagement with the pin 41 permitting the other hand to grasp the handle 44 and lift and operate the cutter. The loop 43 must be engaged throughout the cutting operation thereby insuring safety. The locking member 42 is riveted onto the rear rail 2 through an integral arm 45 that extends along the upper surface of the rail.

Alternatively, the interlock may be provided by a spring loaded safety catch 50, instead of the lock formed by pin 41 and spring arm 42, (FIGS. 5 and 6) catch 50 has a finger or thumb engaging loop 51 at one end and extends axially along the rear rail 12 through a bracket 52. A compression spring 53 yieldingly urges the safety catch 50 to the right as viewed in FIG. 5. The safety catch 50 includes a portion 54 extending longitudinally in a groove 55 in fixed part 25 and a vertically extending portion 56. When the movable part 27 is in engagement with the part 25, the vertical portion 56 extends into a recess 57 in the movable part 27. When the movable part 27 is moved away from the fixed part 25 the spring 43 urges the catch 50 to the right as viewed in FIG. 5 in a position were the portion 56 of the movable part 27 would preclude movement of the movable part 27 downwardly toward the closed position, that is the position were the cutters are engaged. However, if the finger of the user engages the safety catch 50 moving it to the left, against the action of the spring 43, so that the other hand of the operator can move the part 27 and cut the shingle, the vertical portion 56 is aligned with the recess 57 permitting such cutting movement to such a cutting position. In order to fully close the cutter or handling and storage, the safety catch 50 must be moved to the left as viewed in FIG. 5 to permit the movable part 27 to be moved to storage position by extension of the vertical portion 56 and the recess 57. In this position a hook 60 can be engaged.

Figures 1, 5, 6:
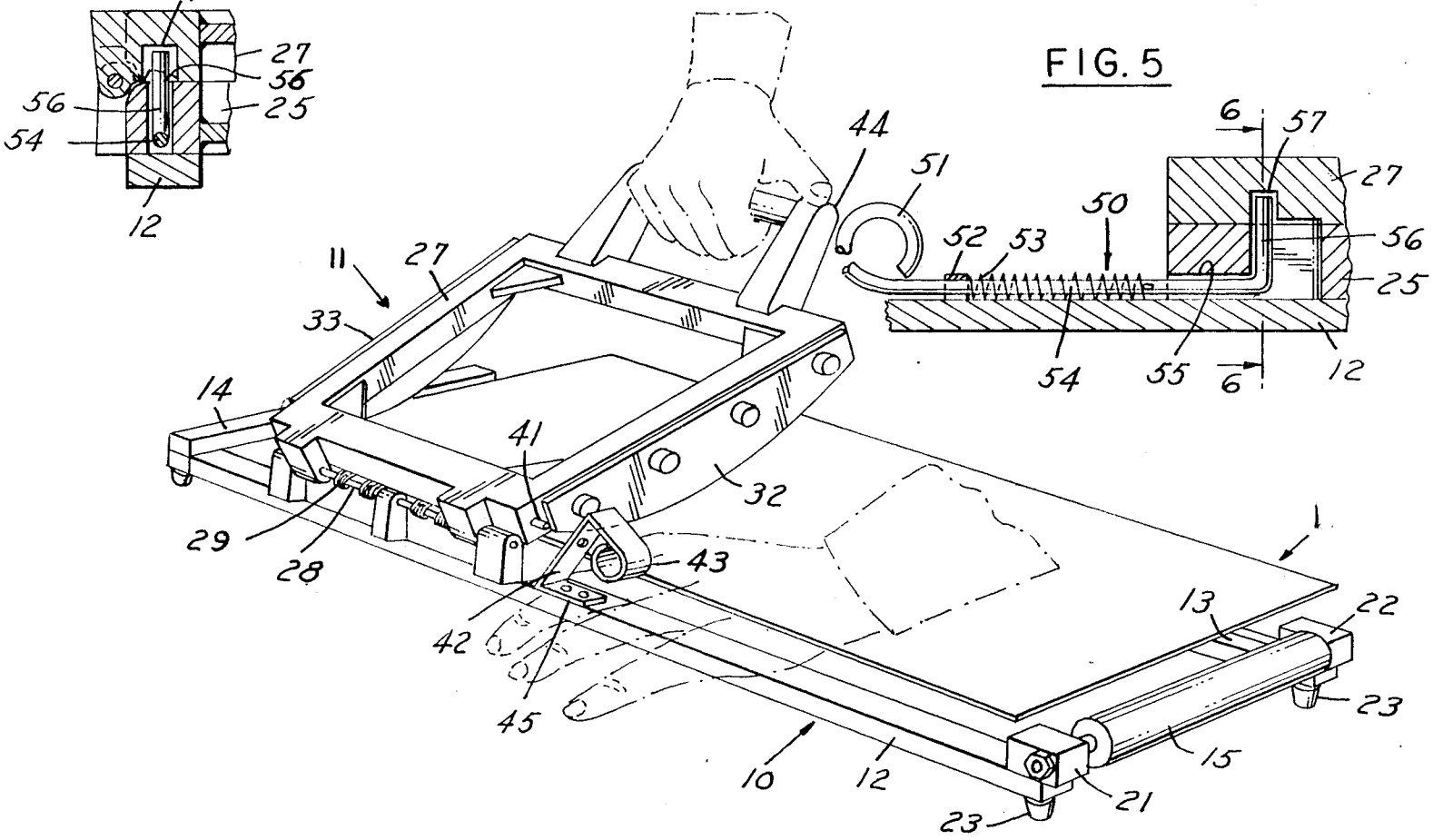
FIG. 1 is a perspective view of a shingle ridge cap cutter embodying the invention showing use in cutting the shingle.
FIG. 5 is a fragmentary longitudinal sectional view of a modified form of interlock structure.
FIG. 6 is a sectional view taken along the line 6—6 in FIG. 5.
Figure 2:
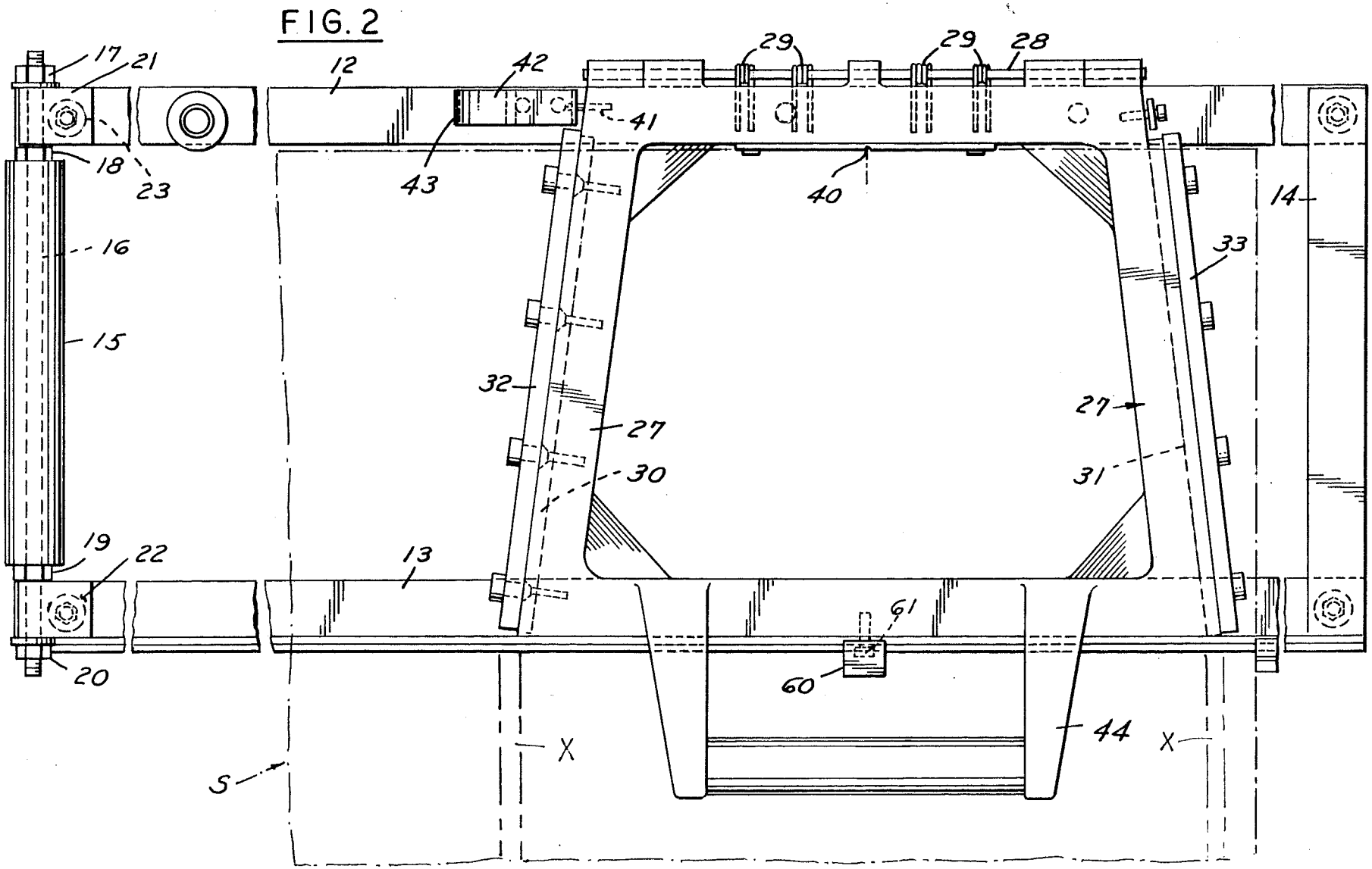
FIG. 2 is a fragmentary plan view of the cutter.
Figure 3:
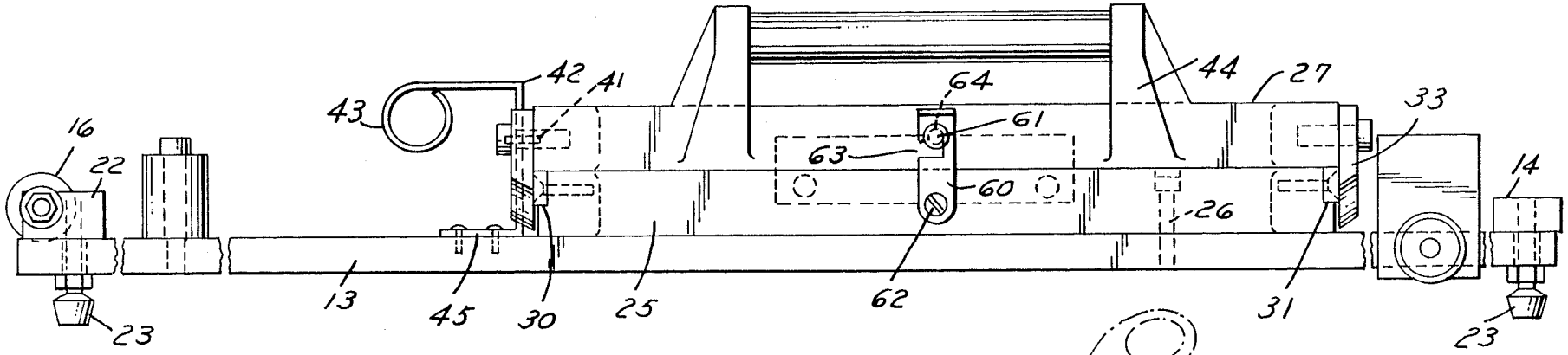
FIG. 3 is a fragmentary front elevational view of the cutter.
Figure 4:
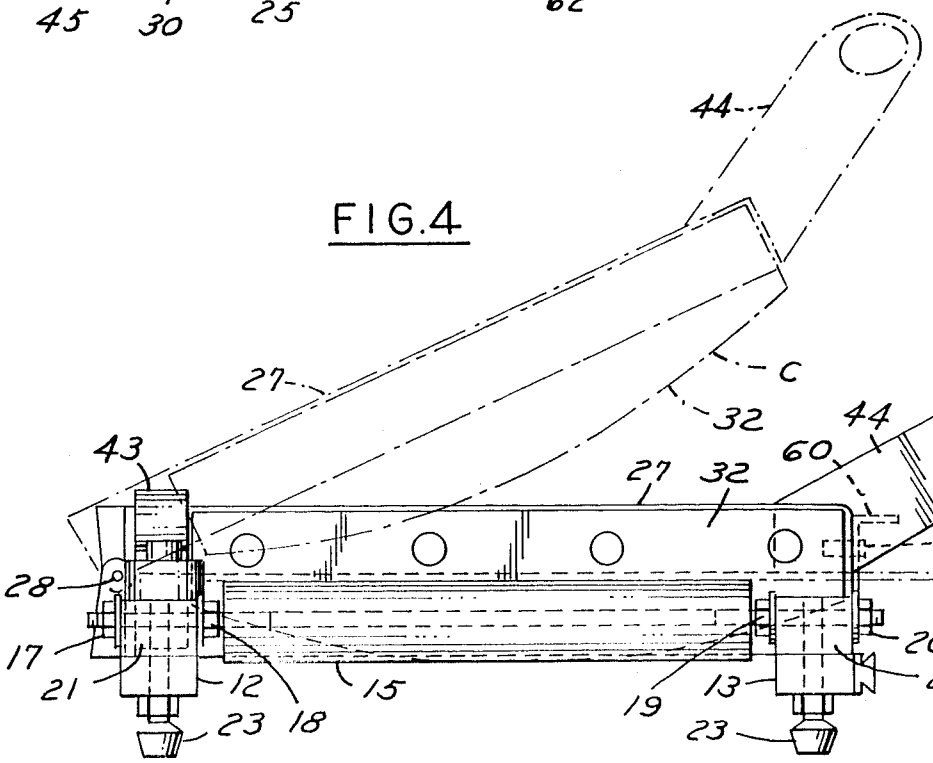
FIG. 4 is a end view of the cutter.

Referring to FIG. 3, the locking 60 is adapted to engage a forwardly extending pin 61 on the movable part 27 and is pivoted to the fixed part 25 by a screw or bolt 62. The hook 60 includes an L-shaped slot 63 that defines a recess 64 into which the pin 61 engages under the action of the torsion springs insuring locking when the cutter has been brought to closed position, the hook 60 engaged and the handle 44 released.

Figure 10:
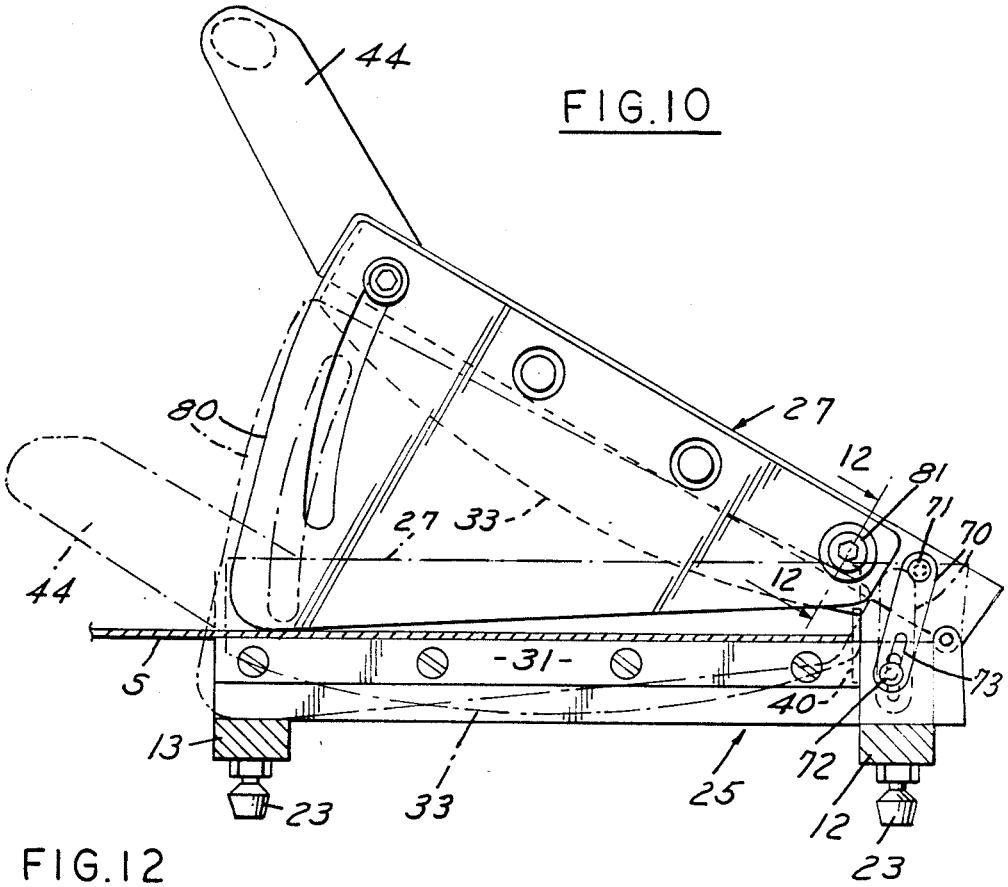
FIG. 10 is a side elevational view of a modified form of cutter.

Referring to the end view of the cutter as shown in FIG. 10, provision is made for limiting the opening movement of the movable part 27 away from the base 25 and comprises a link pivoted by a bolt 71 to the movable part and engaging a fixed bolt 72 on the base 25. The bolt 72 extends through an elongated opening 73. When released, the movable part 27 is yieldingly urged upwardly relative to the base 25 until the base of the slot 73 engages the bolt 72 to stop the upward movement of the part 27. When the movable part is moved downwardly, the slot 73 permits desired movement.

Figure 12:
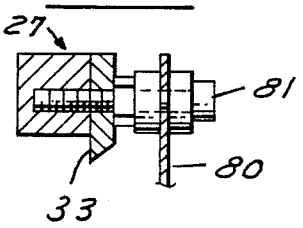
FIG. 12 is a fragmentary sectional view taken along the line 12—12 in FIG. 10.
Figure 11:
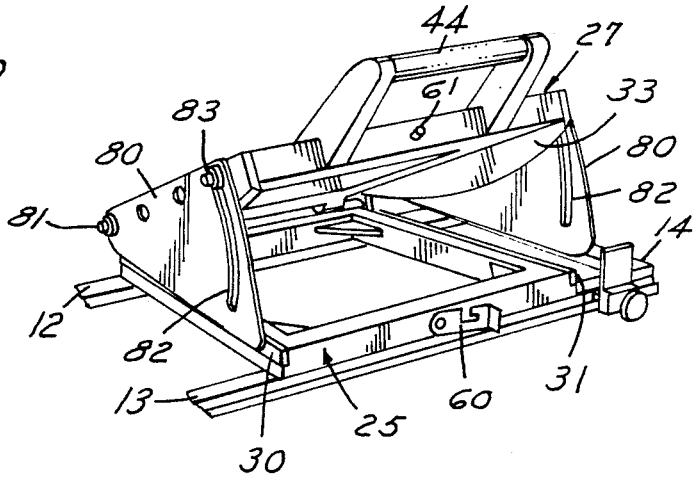
FIG. 11 is a fragmentary perspective view of the cutter shown in FIG. 10.

Also shown in FIGS. 10–12 is another provision for preventing injury to the worker. In this form the device includes a pair of plates 80. Each plate is pivoted through a pin 81 adjacent the hinge of the rear portion of the movable part 27. Each plate 80 is generally rectangular and includes an arcuate slot 82 through which a pin or bolt 83 extends into the movable part 27. When the movable part 27 is in its upward position, the upper ends of the slots 82 engage the pins 83 so that the plates 80 cover the space between the movable part 27 and the base 25. In this manner the hand cannot be inserted between the cutters 33, 31. When the shingle S is inserted for cutting, the movable part 27 is moved downwardly by grasping the handle 44. The lower edges of the plates 80 engage the shingle and continue to close the space between the knifes during this downward movement. At the same time, the slots 82 permit the movable part to move 27, the pins 83 moving downwardly in the slots 82.

It can thus be seen that there has been provided a shingle ridge cap cutter utilizing for cutting uniform sections from roof shingles comprising a frame along which a shingle is guided to a manually operated cutter that comprises spaced blades that are moved to sever a section of the shingle. Provision is made for two-handed operation to prevent injury by an interlock which must be operated by one hand while the cutter is operated by the other hand.

What is claimed is:

1. A shingle ridge cap cutter comprising a frame having an axis means for guiding a shingle along said frame, a fixed cutter member fixed on said frame and supporting longitudinally spaced transversely extending fixed cutter blades, a movable cutter member movably mounted on said fixed cutter member and supporting longitudinally spaced blades movable to cooperate with said fixed cutter blades to sever a portion of a shingle, said fixed and movable center blades extending transversely at an angle to the axis of the frame to permit the shingle to be cut along the slots of a shingle that are provided along the length of a shingle so that the section of the shingle which is cut comprises a combined rectangular portion and a trapezoidal portion, means operable to prevent movement of the movable cutter member toward the fixed cutter member except when one hand is engaged with said means to permit the other hand to manipulate the movable cutter member to cut the shingle, said last mentioned means comprising a safety catch which in one position prevents movement of the movable cutter member toward the fixed cutter member and in another position permits movement of the movable cutter member towards the fixed cutter member, said safety catch being manually movable to a position such that it interferes with the movement of the movable cutter member toward the fixed cutter member, said safety catch comprising a member fixed to said frame and having a flexible portion adapted to engage a complimentary portion on the movable cutter member when the cutter member is in closed position, said safety catch having a finger engaging portion such that when it is grasped and moved laterally, disengages the movable cutter member permitting operation of the movable cutter member with the other hand, said safety catch including a finger engaging loop, said safety catch comprising a portion movable longitudinally of the frame and having a portion at one end for engagement by the hand and another portion at the other end extending toward the movable cutter member, said movable cutter member having a recess which can be engaged with said other portion of said safety catch, spring means yieldingly urging said safety catch in a direction such that when the movable cutter member is moved out cutting position the safety catch and, in turn, the other portion of the safety catch to a position such that said other portion projects toward the movable portion to a position where it is out of alignment with the recess such that it will prevent movement of the movable cutter member toward said fixed cutter member, such that the safety catch must be manually manipulated and held by one hand while the movable part is moved by the other hand to permit the movable cutter member to move so that the portion of the catch extends into the recess as the movable cutter member moves toward cutting position.

2. A shingle ridge cap cutter comprising a frame having an axis, means for guiding a shingle along said frame, a fixed cutter member fixed on said frame and supporting longitudinally spaced transversely extending fixed cutter blades, a movable cutter member pivotally mounted on said fixed cutter member and supporting longitudinally spaced cutter blades movable to cooperate with said fixed cutter blades to sever a portion of a shingle, said fixed and movable blades extending transversely at an angle to the axis of the frame to permit the shingle to be cut along the slots of a shingle that are provided along the length of a shingle so that the section of the shingle which is cut comprises a combined rectangular portion and a trapezoidal portion, means operable to prevent passage of the hand of a worker between the cutter members, said last mentioned means comprising a pair of plates, each plate being pivotally mounted on the movable cutter member adjacent the pivot thereof, lost motion means between the movable cutter member and the plate such that the plate remains substantially in position obstructing movement of a hand of the operator between the cutter members both when the movable cutter member is in its upward position and in its lower cutting position.

3. The cutter set forth in claim 2 wherein said lost motion means comprises an arcuate slot in each said plate, a pin extending through said slot into said movable cutter member such that said cutter member may move from its upper position to its lower position without substantially affecting the positions of the plates.

* * * * *